United States Patent [19]

Krumme

[11] Patent Number: 4,643,500

[45] Date of Patent: Feb. 17, 1987

[54] SHAPE MEMORY ACTUATORS FOR MULTI-CONTACT ELECTRICAL CONNECTORS

[75] Inventor: John F. Krumme, Woodside, Calif.

[73] Assignee: Beta Phase, Inc., Menlo Park, Calif.

[21] Appl. No.: 797,652

[22] Filed: Nov. 13, 1985

[51] Int. Cl.[4] ..... H01R 13/20

[52] U.S. Cl. ..... 339/30; 339/74 R; 339/DIG. 1; 339/176 MP

[58] Field of Search ..... 339/75 MP, 30, DIG. 1, 339/74 R, 176 MP

[56] References Cited

U.S. PATENT DOCUMENTS 3,727,173 4/1973 Goldmann et al. ..... 339/DIG. 1
4,468,073 8/1984 Machcinski ..... 339/176 MP
4,540,228 9/1985 Steele ..... 339/74 R
4,553,803 11/1985 Lapraik et al. ..... 339/74 R

FOREIGN PATENT DOCUMENTS 1439848 6/1976 United Kingdom ..... 339/DIG. 1

*Primary Examiner*—Gil Weidenfeld
*Assistant Examiner*—Paula A. Austin
*Attorney, Agent, or Firm*—Burns, Doane, Swecker & Mathis

[57] ABSTRACT

Shape memory materials, preferably metals, are employed to replace levers to control opening and closing of opposed pairs of contacts in cam operated, multi-contact, zero insertion force connectors; the shape memory material replacing levers for translating or rotating cam actuators in the connectors.

5 Claims, 12 Drawing Figures

SHAPE MEMORY ACTUATORS FOR MULTI-CONTACT ELECTRICAL CONNECTORS

BACKGROUND OF THE INVENTION

The present invention relates to electrical connectors and more particularly to cam operated, multicontact, zero insertion force connectors utilizing shape memory metals to actuate the cam mechanism.

The prior art provides two basic types of cam operated, multicontact, zero insertion force connectors; connectors employing lever operated translating cams and lever operated rotating cams. In both of these types of mechanisms opposed pairs of contacts are pushed apart when the cam is actuated by action of the associated lever and are permitted to return towards a closed position when the cam is returned to its quiescent position. When the contacts are separated a printed circuit board may be inserted with zero insertion force and is tightly clamped between the contacts when the contacts are released.

In the translatable cam operator type, an elongated structure has a long slide disposed along each side of the elongated body. The body has two rows of closely spaced electrical contacts, with each row located in an array parallel to and inwardly of one of the slides. A contact in each row has a contact in the other row opposed thereto with each being located in a common plane perpendicular to the elongated dimension of the body.

In the unactuated condition, the opposed contacts of each row are closely spaced in the transverse planes such as to rest firmly against contacts located on opposite sides of a printed circuit board or the like located in the connector. The board is held firmly in place.

When a board is to be withdrawn or inserted, the slides are translated, and cams carried thereon cause the opposed contacts to be spread to a spacing greater than the thickness of the board. Thus, a board may be inserted or withdrawn essentially without contact between the board and connector.

A rotatable cam actuator lies along the center line of the connector and upon rotation pushes up a bail that pushes the opposed contacts apart.

In both types of lever actuated cams, large amounts of space must be provided for movement of the lever and the levers must be located such that an operator can get his hand or a tool to the lever to operate it. In electronic equipment using large numbers of these connectors such as computers, telecommunications equipment and other complex electronic equipment, the space and accessibility requirements impose restrictions on the use of such connectors or where used on the geometry of the equipment.

On the other hand, the basic concepts of the connectors are valid and are written into the specifications for numerous equipment lines currently in production by numerous original equipment manufacturers. Thus, if such connectors can be improved by a change only in the cam actuator, a large market for such a device is already in place, especially if the modified device provides fail safe operation.

SUMMARY OF THE INVENTION

In accordance with the present invention, the manually operated, lever-type cam actuators of the prior art multicontact, zero insertion force, electrical connectors are modified by replacing the manually-operated levers with a shape memory, remotely-controlled operator. As applied to the translatable slide cam operator, the slide operating lever mechanism is removed from one end of the device and terminal posts for the two ends of a conductive shape memory wire are applied. A split end member or cap is secured to and between the two slides and has an arcuate channel to receive the wire. A compression spring coaxial with the elongated center line of the device extends in compression between the end cap and a shoulder secured to the base of the connector.

The shape memory material, which may be nitinol (NiTi) in its martensitic state may be readily stretched, but in its austenitic state returns to its shape memory geometry and is extremely strong. The shaped wire as used in the present invention has a memory length such as to cause the slides to be pushed into their camming position, i.e. toward the terminals of the wire. To cause the material to assume its shape memory, i.e. to assume its austenitic state, the wire must be heated above room temperatures, say to 160° F. Heating is accomplished by applying a source of electrical current across the terminals for the wire. In the unheated state the wire assumes its relaxed, stretchable state, in this case the temperature is in the range of normal room temperatures or to provide a margin for error, say below 110° F.-130° F.

In operation, the shape memory material is normally in its martensitic state and is readily stretched by the compression spring. The end cap is translated away from the opposite end of the device and carries the slides with it, allowing the opposed contacts to move inwardly towards each other. When it is desired to release a board, the wire is heated, it assumes its shape memory (austenitic) state, that is, the length of the wire decreases and causes the end cap to compress the spring and move the slides into their camming position. The contacts are separated and a board may be readily inserted or withdrawn.

Upon termination of heating, the wire goes through a martensitic transition, becomes relatively soft and is stretched by the action of the compression spring against the end cap. The slides are withdrawn from their camming position and the contacts move toward one another.

In the case of the rotatable camming type connector actuator, the rotatable camming member of the prior art is preferably replaced by a C-shaped or S-shaped NiTi member located under the bail. Upon heating of the NiTi, the "C" or "S" member extends or pushes up on the bail thereby opening the contacts.

In an alternative arrangement requiring less NiTi a hollow rotatable tube with a camming surface is disposed under the bail. A shape memory torsion rod is located along the axis of the tube, is anchored to an end wall of the tube at one end and to the frame of the connector at the other end. A torsion spring applies a rotation force to the tube to position it out of its camming position such that the opposed connector contacts are closely spaced.

The torsion rod has a memory such that when in its austenitic state it causes the camming tube to be rotated to its camming position. Preferably, the torsion rod is in a relaxed non-twisted condition when in its martensitic state. When it is desired to open opposed contacts, the rod is heated by passing electric current through it or a heater attached to it and the tube is rotated against the force of the torsion spring. Upon cooling of the nitinol, the torsion spring is sufficiently strong to rotate the tube against the force of the rod.

DETAILED DESCRIPTION OF THE DRAWINGS

Figure 1:
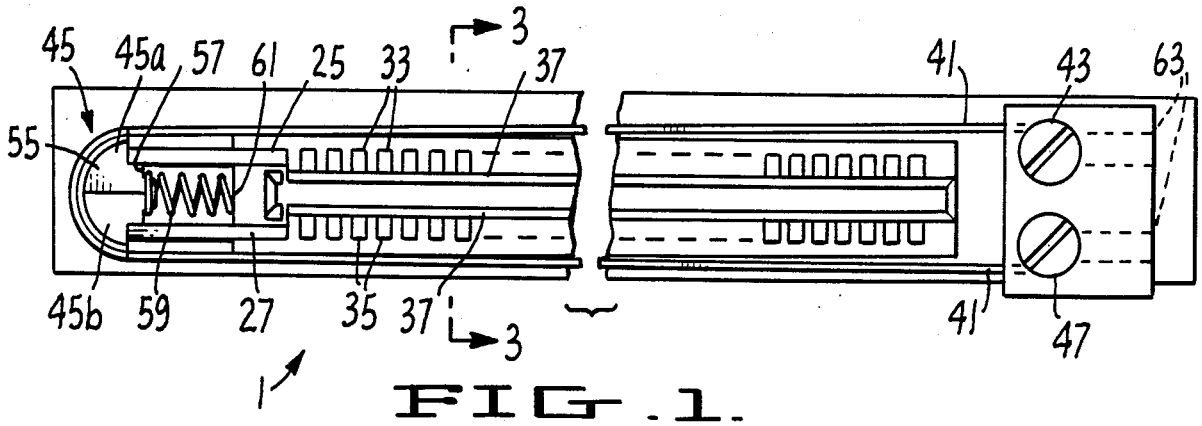
FIG. 1 is a top view of the translated slide version of the connector of the present invention.
Figure 3:
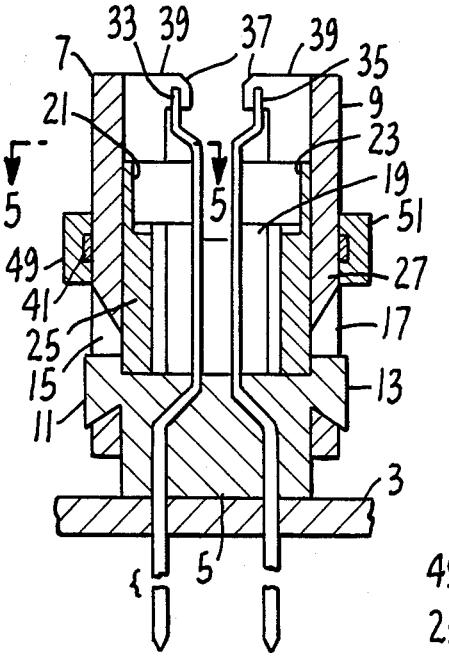
FIG. 3 is a section view taken along section line 3—3 of FIG. 1 illustrating the connector in its closed contact state.
Figure 4:
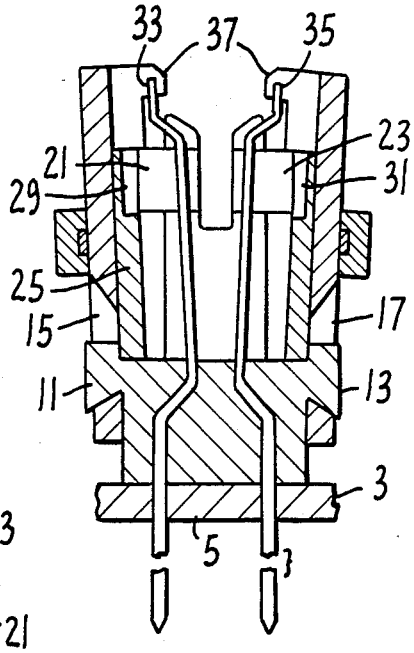
FIG. 4 is a section view taken along section line 3—3 of FIG. 1 illustrating the connector in its open contact state.

Referring now specifically to FIG. 1 of the accompanying drawings, there is illustrated a top view of a cam operated connector employing slides as the cam actuator. The connector, generally designated by the reference numeral 1, has a base 3 to which is secured, see FIGS. 3 and 4, a main body 5 supporting a pair of sidewalls 7 and 9. The sidewalls 7 and 9 are secured to the body 5 by ears 11 and 13 which pass through apertures in the walls and are turned over to hold the walls securely in place. The walls are provided with a plurality of axially arrayed indentations 15 and 17 to render the sidewalls flexible; that is, outwardly bendable as illustrated in FIG. 4.

Figure 5:
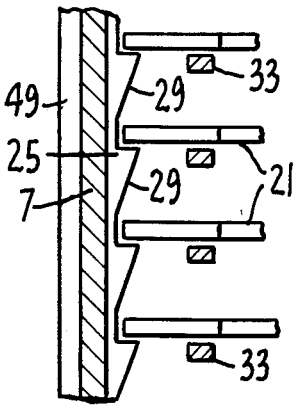
FIG. 5 is a partial view taken along section line 5—5 of FIG. 3.
Figure 6:
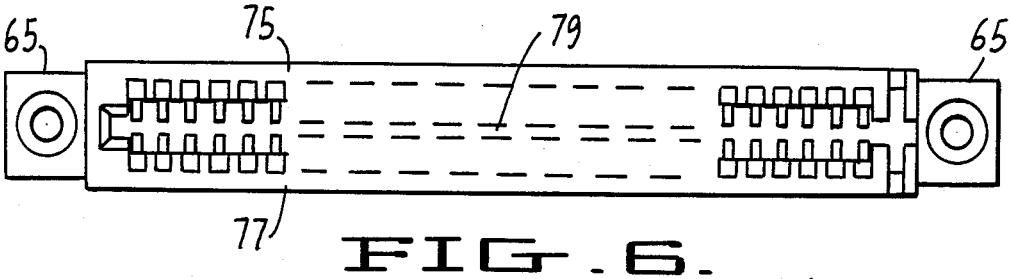
FIG. 6 is a top view of a second embodiment of a connector of the invention.
Figure 7:
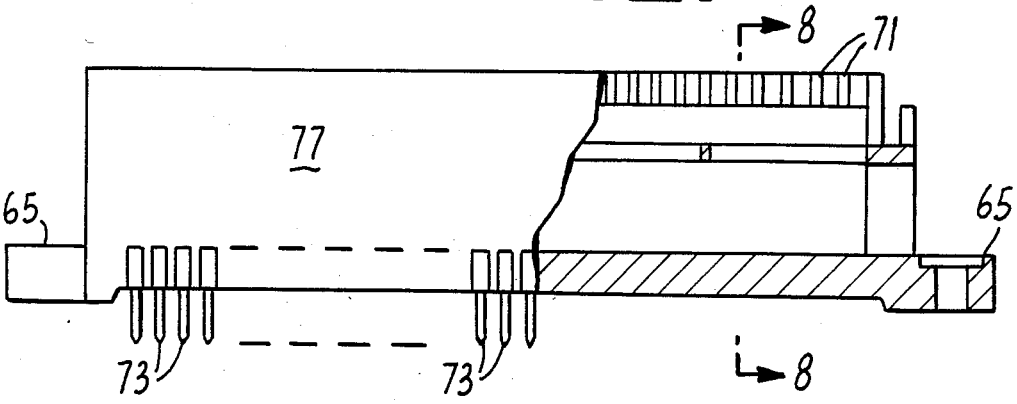
FIG. 7 is a side view of the connector of FIG. 6.

The body 5 has a plurality of upwardly extending axially-spaced members 19 terminating in a plurality of pairs of outwardly extending projections 21 and 23 providing solid surfaces for engagement by the camming surfaces of the slides 25 and 27, respectively, see FIG. 5. More specifically, slides 25 and 27 have a plurality of axially-spaced triangular camming surfaces 29 and 31, respectively, which normally are out of engagement with the projections 21 and 23. When the slides are moved downwardly as viewed in FIG. 5 of the accompanying drawings, the cam surfaces 29 and 31 ride up on the projections 21 and 23 forcing the slides away from the center of connector and causing them to push out on the sidewalls 7 and 9, respectively.

Electrical contacts 33 and 35 are axially-arrayed along opposite sides of the center line of the connector; each pair of contacts on opposite sides of the outer axis being aligned in a plane perpendicular to such axis. Each contact is molded in the main body 5 and disposed between the members 19 and 21 and 23. Each contact has its upper end disposed outwardly of an ear 37 formed on the inner end of an inward extension 39 from sidewalls 7 and 9. Specifically, the ear 37 extends axially of the upper end of its associated contact 33 or 35 and inward of it so that when the sidewall 7 or 9 moves outwardly, the ear 37 pulls the contact away from its centralmost position as illustrated in FIG. 3, to an outward position as illustrated FIG. 4. In this latter position, a circuit board may be inserted with zero insertion force. After a board is inserted, the contacts 33 and 35 are permitted to return to their inward position as illustrated.

The actuation mechanism for the slides comprises, as previously described, a nitinol wire that when heated, shortens and when cooled is stretched by a compression spring whereby the slides are pushed and pulled to open and close the spacing between the contacts, respectively. More particularly, a nitinol wire 41 extends from a first electrical terminal 43 down one side of the connector around a split end member 45 and back along the other side to a second terminal 47. The wire is disposed along the sides of the connector in cavities formed between the sidewall 7 and a U-shaped member 49 secured to the sidewall 7 and the sidewall 9 and U-shaped member 51 secured to that sidewall. The wire is seated in a groove 53 in the semi-circular end member 45.

The end member 45 is split into two members **45*a* and 45*b* with each secured to a different one of the slides 25 and 27. The end member is split so that it may accommodate minor variations in travel of the slides. The member 45 has a projection 55 providing a flat transverse surface 57 for engagement with one end of a resilient means in the form of compression spring 59. The body 5 provides a surface 61 for engaging the other end of the compression spring. To complete the description, a source 63 of electrical energy is adapted to be connected across the terminals 43 and 47**.

Figure 2:
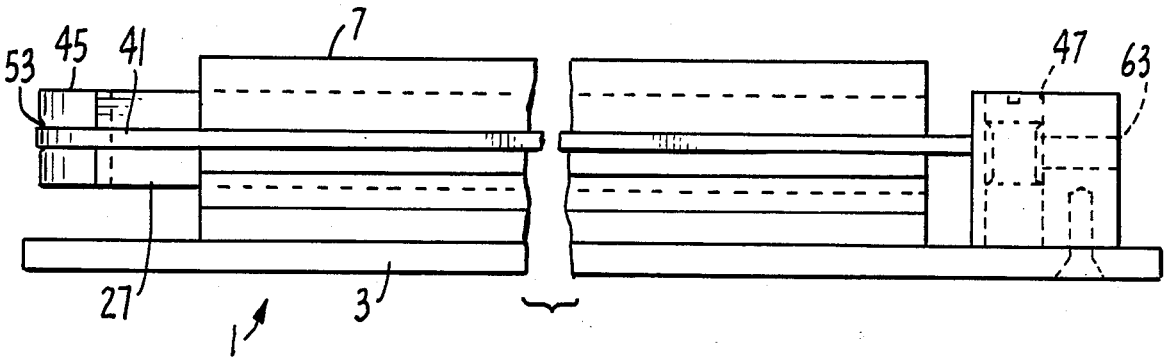
FIG. 2 is a side view of the connector of FIG. 1.

When it is desired to insert or withdraw a p.c. board, the source 63 is applied across terminals 43 and 47 and the nitinol wire 41 is heated. The wire undergoes a martensitic to austenitic transistion and the wire assumes its memory state which is shorter than illustrated in FIGS. 1 and 2. The end member 45 is pulled toward terminals 43 and 47 and the slides are pushed from the position illustrated in FIG. 4. The cams 29 and 31 ride up on the projections 21 and 23 and the sidewalls 7 and 9 are cammed out, carrying contacts 33 and 35 with them and thus providing sufficient separation to permit zero insertion or withdrawal force. When it is desired to have the contacts return to the clamping position of FIG. 3, current is removed from the wire 41, the wire cools and undergoes an austenitic to martensitic transition. The wire loses sufficient strength to be stretched by the compression spring 59, the slides return to the position illustrated in FIG. 3 and the contacts close.

Note that the operation of the device is fail safe. If the nitinol wire breaks, the contacts are maintained closed by the action of the compression spring 59, thus insuring continued operation of the equipment. It should be remembered, however, that nitinol wires have unusually long lives which normally will outlast the equipment.

Referring now specifically to FIGS. 6–9, there is illustrated a second embodiment of the present invention. Again a base plate 65 has mounted thereon a body member 67 having opposed pairs of contacts 69 and 71 molded therein with extensions (pins) 73 extending through the base plate 65. Each of the contacts is one of a plurality of axially-arrayed contacts of a multi-contact connector, as viewed particularly in FIG. 6.

Each contact has an inwardly bowed (arcuate) region 74 whereby the contacts closely approach one another.

The contacts are made of resilient material, such as beryllium-copper, and are located between protective sidewalls 75 and 77 which may constitute upward extensions of the body 67.

A U-shaped bail 79 is located between the lower region of body 67 and the bowed region 74 of the contacts 69 and 71. The legs of the bail 79 are normally located below the regions 74 of the contacts so that the contacts assume the dashed line position of FIG. 8. The actuator employed to control movement of the bail 79 is an S-shaped (could be C-shaped) nitinol member 81 which when the contacts are to be closed assumes the illustrated dashed line position. When the contacts are to be opened the member 81 assumes the solid line position of FIG. 8, pushing the bail 79 also to its solid line position of FIG. 8. The legs of the U-shaped bail now engage the regions 74 of the contacts 69 and 71 and push them apart.

Figure 8:
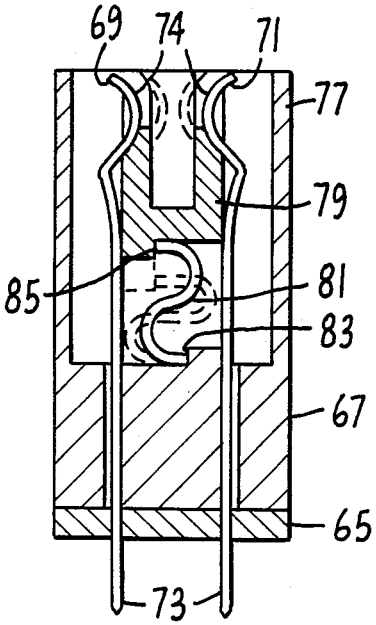
FIG. 8 is a section view taken along section 8—8 of FIG. 7.
Figure 9:
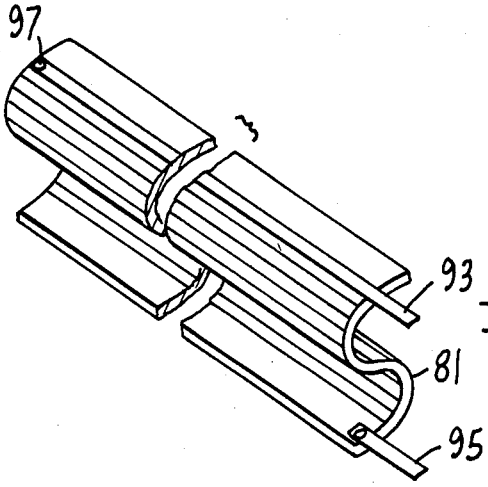
FIG. 9 is a perspective view of the actuator of FIG. 8.

The nitinol member has a memory shape as indicated by the solid line shown in FIG. 8 so that when heated sufficiently to acquire its austenitic state it expands vertically, shoulder 83 of the body 67 preventing rotation of the member 81, and pushes up on the bail 79, which also has a shoulder, reference numeral 85, to prevent rotation. Upon cooling, means must be provided to return the member 81 to the dashed line position. This operation can be accomplished in several ways. If the spring force of the line of contacts 69 and 71 is sufficient, this force will comprise a resilient means and can be used to force the bail 79 down and cause the member 81 to return to its dashed line position when it cools to its martensitic state.

Figure 10:
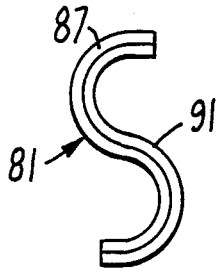
FIG. 10 is an end view of a modification of the nitinol element of FIG. 9.

If the spring force of the contacts 69 and 71 is not sufficient, then the member 81 may be as illustrated in FIG. 10. The member 81 is comprised of two materials, nitinol and spring steel 87 and 91, respectively. The spring steel comprises a resilient means and has sufficient force to return the member 81 to the dashed line state of FIG. 8 when the nitinol is in its martensitic state and the nitinol exerts sufficient force in its austenitic state to assume its solid line position of FIG. 8.

The member 81 may be heated by passing electric current directly through the member or by having a heater bonded to its surface. In either case a pair of leads 93 and 95 are provided for connection to a source of electricity. If the nitinol is to receive current directly the lead 93 is insulated from the nitinol, preferably by kapton except at the far end, as indicated by reference number 97. Current then will flow through the nitinol body. If a heater is employed it may take the form illustrated in FIG. 14 of U.S. Pat. No. 4,550,870 to Krumme, et al. issued Nov. 5, 1985. It should be noted that in the collapsed position the nitinol member may contact the contacts 69 and 71. Thus it is preferably covered with insulation such as kapton.

Figure 11:
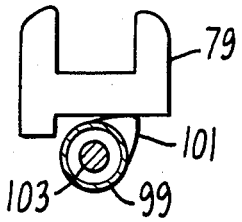
FIG. 11 is a schematic end view of a rotational form of actuator for the bail for FIG. 8.
Figure 12:
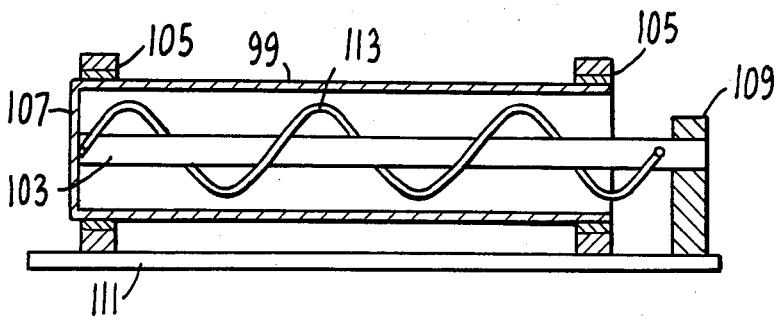
FIG. 12 is a schematic side view of the mechanism of FIG. 11 illustrated as if all elements were transparent.

Referring now to FIGS. 11 and 12 of the accompanying drawings, there is illustrated an alternative to the member 81 of FIGS. 6–10. The member for actuating the bail 79 of FIG. 8 is a hollow tube 99 having one end closed. The tube is cylindrical over about 315° of its surface and has an arcuate protrusion extending over the remaining 45° of its circumference to provide a camming surface. The tube extends under the entire length of bail 79 and when in the position illustrated in FIG. 11, the bail is retracted and the contacts are closed. Rotation of the tube through about 45° causes the bail to move upward, as illustrated in FIG. 11, sufficiently to open contacts 69 and 71.

The tube 99 is journaled at its ends in bearings 105; the tube being round at these locations. A nitinol rod 103 extends along the axis of and is coaxial with the tube 99 and is secured to wall 107 closing the left end, as viewed in FIG. 12, of the tube 99. The right end of rod 103 is rigidly held by a clamp 109 mounted on base 111. A torsion spring 113 is disposed interially of the tube 99 and about the rod 103; being secured to the rod at its two ends.

The rod 103 in its memory condition is biased such as to rotate the tube 45° counterclockwise from the position illustrated in FIG. 11. Thus when the rod is heated through its martensitic to austentic transition temperature, the rod twists, the tube 99 is rotated, the bail 79 raised and the contacts separated. When the rod is cooled the resilient means in the form of spring 113 rotates the rod and thus the tube back to the position illustrated in FIG. 11.

Again the operation of the system is fail safe, since the bail is returned to its inactive position upon any failure of the NiTi or its activating circuits.

Other improvements, modifications and embodiments will become apparent to one of ordinary skill in the art upon review of this disclosure. Such improvements, modifications and embodiments are considered to be within the scope of this invention as defined by the following claims.

I claim:

1. A cam operated, multi-contact, zero insertion force electrical connector comprising:

a plurality of pairs of opposed electrical contacts;

means for supporting said pairs in parallel rows along an elongated dimension of the connector;

means for supporting each contact of said opposed pair of contacts for movement to positions toward and away from one another;

resilient means for biasing said contacts of said opposed pairs of contacts in one of said contact positions;

cam means having a first position and a second position, said cam means in its first position biasing said contacts of each said pair of opposed contacts in the other of said contact positions, said cam means being a slide having camming surfaces;

shape memory cam operating means having a martensitic state at room temperatures and an austenitic state above room temperatures, said cam operating means having a shape memory in its austenitic state to move said cam means to its first position, said cam operating means being a wire of shape memory material, said wire in its austenitic state capable of moving said slide to a position where said cam means is in its first position moving said opposed contacts away from one another, said resilient means capable of moving said slide to said cam means second position when said wire is in its martensitic state; and means for selectably heating wire to cause it to translate to its austenitic state.

2. A cam operated, multi-contact, zero insertion force electrical connector comprising:

a plurality of pairs of opposed electrical contacts;

means for supporting said pairs in parallel rows along an elongated dimension of the connector;

means for supporting each contact of said opposed pairs of contacts for movement to positions toward and away from one another;

resilient means for biasing said contacts of said opposed pairs of contacts in one of said contact positions;

cam means having a first position and a second position, said cam means in its first position biasing said contacts of each said pair of opposed contacts in the other of said contact positions, said cam means being a hollow tube having a circumferential camming surface and an end wall;

means for supporting said tube for rotation;

shape memory cam operating means having a martensitic state at room temperatures and an austenitic state above room temperatures, said cam operating means having a shape memory in its austenitic state to move said cam means to its first position, said cam operating means being a torsion rod of shape memory material, said rod being secured at one end to said end wall of said tube and at its other end capable of being operatively connected to a rigid support, said resilient means capable of biasing said tube to a first rotational position when said rod is in its martensitic state, said rod in its austenitic state capable of overcoming the biasing of said resilient means to move said tube to a second rotational position; and means for selectably heating said rod to cause it to translate to its austenitic state.

3. A cam operated, multi-contact, zero insertion force electrical connector comprising:

a plurality of pairs of opposed electrical contacts;

means for supporting said pairs in parallel rows along an elongated dimension of the connector;

means for supporting each contact of said opposed pairs of contacts for movement to positions toward and away from one another;

resilient means for biasing said contacts of said opposed pairs of contacts in one of said contact positions;

cam means having a first position and a second position, said cam means in its first position biasing said contacts of each said pair of opposed contacts in the other of said contact positions, said cam means being a bail supported for movement between said contacts to push them apart from one another;

shape memory cam operating means having a martensitic state at room temperatures and an austenitic state above room temperatures, said cam operating means having a shape memory in its austenitic state to move said bail to its first position, said cam operating means being a curved member of shape memory material, said curved member capable of moving said bail to a first position when said curved member is heated to its austenitic state, said resilient means capable of moving said curved member to its second position when said curved member is in its martensitic state, said curved member having less curvature in its austenitic state than in its martensitic state under the influence of said resilience means; and means for selectably heating said curved member to cause it to translate to its austenitic state.

4. A connector as in claim 3 wherein said curved member of shape memory material is "S" shaped.

5. A connector as in claim 3 wherein said curved member of shape memory material is "C" shaped.

* * * * *